United States Patent [19]

McClenny

[11] Patent Number: 4,815,735

[45] Date of Patent: Mar. 28, 1989

[54] PITCHING MACHINE

[76] Inventor: Carl O. McClenny, 6154 Willer's Way, Houston, Tex. 77057

[21] Appl. No.: 422,832

[22] Filed: Sep. 24, 1982

[51] Int. Cl.[4] ..... A63B 69/40

[52] U.S. Cl. ..... 273/26 E

[58] Field of Search ..... 273/26 R, 26 D, 26 E, 273/29 A, 58 C, 414, 413

[56] References Cited

U.S. PATENT DOCUMENTS

| | | | |
|---|---|---|---|
| 2,058,277 | 10/1936 | Walther | 273/26 E |
| 2,818,255 | 12/1957 | Ponza | 273/26 E |
| 3,333,847 | 8/1967 | Pennington | 273/26 E |
| 3,408,070 | 10/1968 | Gonzales et al. | 273/26 E |
| 3,547,437 | 12/1970 | Anderson | 273/26 E |
| 3,588,104 | 6/1971 | Griffin | 273/26 E |
| 3,637,208 | 12/1972 | Allred | 273/26 E |
| 3,799,105 | 3/1974 | Porter | 273/26 E |
| 3,885,790 | 5/1975 | Parr | 273/26 E |
| 3,942,794 | 3/1976 | Gowins | 273/26 E |

FOREIGN PATENT DOCUMENTS

| | | | |
|---|---|---|---|
| 712035 | 6/1965 | Canada | 273/26 E |

*Primary Examiner*—Richard C. Pinkham
*Assistant Examiner*—T. Brown

[57] ABSTRACT

A tethered ball baseball pitching practice apparatus whereby the apparatus is comprised of a support base having a rotatable, vertically extending post attached thereto. Attached to the upper end of the post is one end of an elongated horizontally extending arm. The free end of the horizontal arm has attached thereto a semi-rigid arm. A ball is attached to a free end of the semi-rigid arm. The arm is provided with spring elements to dampen oscillation of the ball after being struck by a batter.

3 Claims, 2 Drawing Sheets

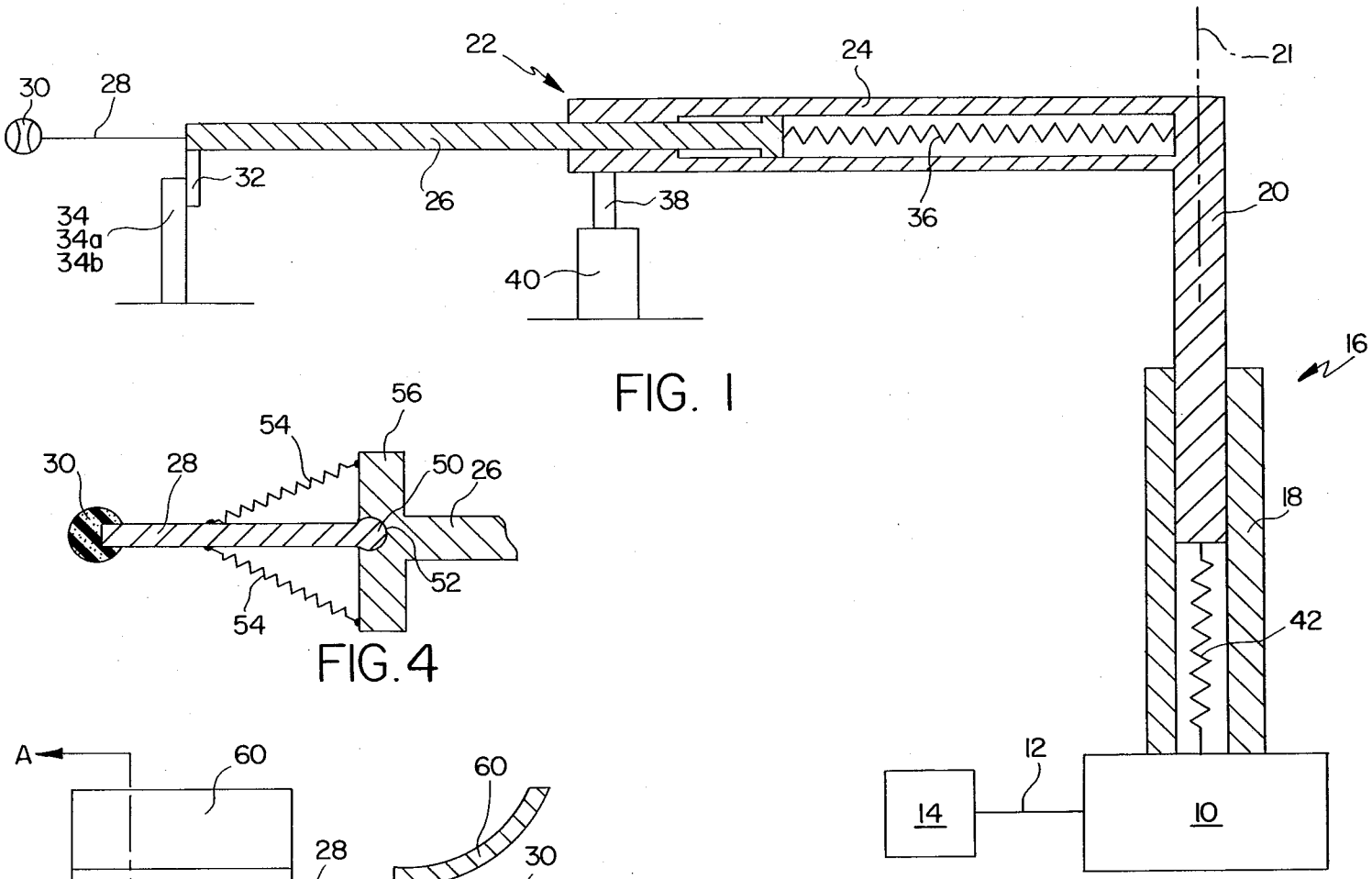
FIG. 1
FIG. 4
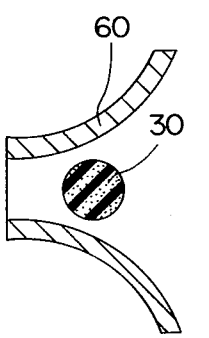
FIG. 3A
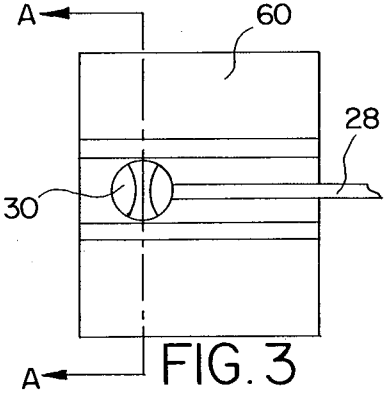
FIG. 3

PITCHING MACHINE

BACKGROUND OF THE INVENTION

1. Field of the Invention

The invention relates to a pitching machine for batting practice as in baseball or softball.

2. Description of the Prior Art

Hand-eye coordination is vitally important in batting a pitched ball. Therefore, the more practice a batter gets at batting pitched balls, the better his hand-eye coordination becomes. The more realistic it is, the better, but no team has enough pitchers to give each potential batter, including other pitchers, adequate "game-like" batting practice. Existing pitching machines are helpful but do not provide the speed, trajectory and variation of pitches that a batter will see in a game. Thus, a batter's timing is not optimized.

SUMMARY OF THE INVENTION

The invention comprises a horizontally rotating resilient arm having a ball rigidly mounted at its free end. Variations in arm length and height may be controlled by cam and cam-follower type mechanisms thereby allowing variations in ball trajectory. Speed of the ball is controlled simply by the rate of revolution of the arm.

BRIEF DESCRIPTION OF THE DRAWINGS

FIG. 1—Side elevation of the invention.

FIG. 3—Views of the damping member.

FIG. 3A—A crossection view on line A—A of FIG. 3.

FIG. 4—Views of the pivotal embodiment.

The invention in its basic embodiment comprises a boom or arm, rotatable in a generally horizontal plane, and having a variable height and reach. In the schematic, FIG. 1, 10 is a means for providing rotation such as a motor/gear box arrangement. Power and control signals are provided to the motor 10 by a control box 14 with interconnection being provided by conduit 12. The shaft of the motor 10 is rigidly attached to, and causes rotation of, the vertical mast 16 which has a fixed length portion 18 and an extendible/retractable portion 20 for providing variations in elevation. The portion 20 is slidably fixed so as to move vertically within portion 18 but is keyed so as to rotate in unison with portion 18. Mast 16 is resistant to bending moments. Fixedly connected to the extendible/retractable portion 20 of the mast 16 is a boom or arm 22, also resistant to bending moments, which rotates with the mast 16. The boom 22 likewise has a fixed length portion 24 and an extendible/retractable portion 26. At the outboard end of the extendible portion 26 is a resilient or semi-rigid tether 28 which may be removably attached but which is preferably of fixed length. Attached to the tether 28 is a ball 30. As the mast 16 is rotated by the motor 10 about its vertical axis 21, the boom 22, tether 28 and ball 30 are caused to rotate in a generally horizontal plane.

FIG. 2 represents one quadrant of the circle (path) which would be projected onto the ground by the ball 30 as it revolves around the vertical axis 21 at a distance R therefrom. The radius R is the length of the horizontal boom 22 plus the length of the tether 28. With counterclockwise rotation, the point P1 on the circumference represents the point at which a ball would be released by a pitcher, and the point P2 represents a point over home plate at which the ball 30 could be batted by a right-handed batter standing at point A. The points P1 and P2 on the circumference are actually interchangeable depending upon whether the batter is right handed or left handed. A left handed batter, for example, would stand at a point B opposite the point P1 and the motor 10 would be reversed so as to rotate the mast 16 and boom 22 in a clockwise direction. The point P2 would then represent the point of release by the pitcher and the point P1 a point over home plate. The chord (distance between points P1 and P2 of the quadrant) represents the distance from the pitcher's rubber to home plate, which, for a regulation baseball game, is approximately 60 feet. It will be appreciated that this distance (chord) will decrease for softball and for Little League games. This decrease may be accomplished either by moving the points P1 and P2 closer together on the circumference of the diagram shown or by decreasing the radius R thereby decreasing the maximum length of the boom 22 and tether 28. The radius R of approximately 42.5 feet will provide a chord distance (for a quadrant) of approximately 60 feet between points P1 and P2. A ball 30 travelling the circumference between P1 and P2 (or P2 to P1) will appear to a batter (either right handed or left handed) to be a very wide-breaking inside curve. It follows then that the chord P1-P2 will describe the path FB of a "fast ball"; i.e., a ball trajectory having no curvature in the horizontal plane.

Figure 2:
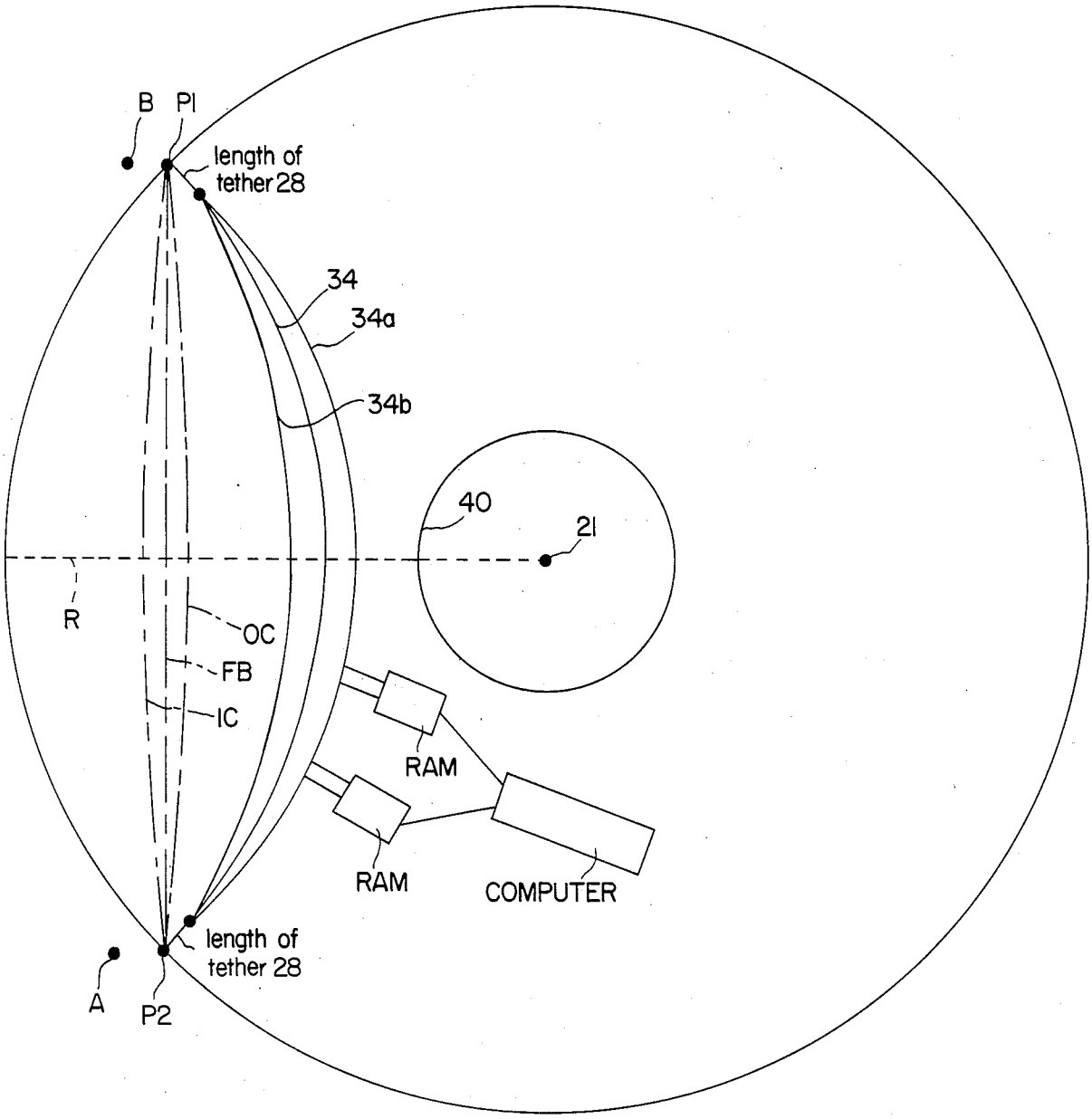
FIG. 2—Plan view of the invention.

In order for the ball 30 to follow the path of the chord P1-P2 (rather than the circumference), it is necessary that the combined length R of the boom 22 and the tether 28 constantly change as they revolve around the vertical axis 21 of the mast 16 between the points P1 and P2. This may be done, for example, by a cam 34 located inwardly of the chord P1-P2 and a cam-follower 32 fixedly attached to the extendible portion 26 of the boom 22. As the boom 22 rotates, the cam-follower 32 follows the cam 34 (which may be simply a vertical wall) and causes the portion 26 to collapse into (and extend from) the portion 24 thereby decreasing (and increasing) the combined length R of the boom 22 and tether 28. The portion 26 is biased, for example, by a spring 36, to assume its maximum length. It will be appreciated that the cam 34 may be designed such that the ball 30 may be caused to follow any desired path between points P1 and P2. For example, if the cam-follower 32 follows a cam such as 34*a*, the ball 30 will follow the path OC and will appear to a batter at A or B to be an "outside curve". Similarly, a cam may be positioned to cause the ball 30 to follow the path of an "inside curve" IC having any desired "breaking" characteristics.

For a radius R of 42.5 feet, the portion 26 must collapse into the portion 24 a distance of 12.5 feet midway between points P1 and P2 in order to simulate a fastball FB. An outside curve OC would require additional collapsing length.

In a similar manner, the height of the ball 30 over the path it takes between points P1 and P2 may be made to rise and fall in accordance with any desired limits. For example, a second cam-follower 38 may be caused to ride or "follow" a second cam 40 thereby causing the boom 22 and mast 20 to rise and fall with variations in the upper surface of the cam 40. The movable portion 20 of the mast 16 may be biased in its lowest position by a spring 42 or, even more simply, by gravity. Thus, by design of the cams 34 and 40, the ball 30 may be made to follow any selected path between the points P1 and P2.

Speed of the ball 30 is controlled simply by speed of rotation of the boom 22. Thus, for a maximum radius R of 42.5 feet, one complete revolution of the boom 22 every two (2) seconds, i.e., 30 revolutions per minute, would yield a ball 30 velocity of approximately 90 miles per hour (132 feet per second) on the circumference. This velocity relates closely to the velocity of a fast ball thrown by the better pitchers in professional baseball. It is easily seen that by controlling the speed of the motor/gear box 10, any desired speed of the ball 30 may be obtained. It follows then that virtually any pitch of any pitcher may be accurately duplicated by this invention.

The cams 34 and 40 may be fixed in one position or they may be movable. For example, the cam surfaces may be flexible material, such as sheet metal, and may be moved by a series of hydraulic or electric rams located along, and attached to the back side of, the cams 34 and 40. By these means the cams 34 and 40 may be computer-controlled and thereby changed from pitch to pitch. The cam-followers, in one simple form, could be wheels rolling on the cam surfaces. Similarly, the extendible portion of the mast 16 and arm 22 may be varied directly by means of hydraulic or electric means thereby obviating the need for the cams and followers.

When the ball 30 is batted, the tether portion 28 of the arm 22 will oscillate and must be damped prior to its approaching the batter for the next swing. FIG. 3 depicts a damping member 60 through which the ball 30 and a portion of the tether 28 passes prior to entering the quadrant between points P1 and P2. The damping member 60 "funnels" the ball 30 to an exit point (pitcher's release point) which is at essentially the same elevation as the horizontal arm 22. The damping member 60 must be vertically adjustable so as to align the exit point with the pitcher's release point. The damping member 60 may be lined with absorbent material such as carpeting to increase the damping action.

Refering now to FIG. 4, the tether 28 may also be a stiff, rod-like member pivotally attached to the extendible portion 26 of the arm 22. The tether portion 28 and extendible portion 26 are pivotally joined by means of a ball 50 and socket 52. When the ball 30 is struck by a bat, the ball 30 rebounds and forces the tether 28 to pivot in the socket 52. But the tether 28 is forced back to its erect position, i.e., in axial alignment with extendible portion 26, by springs 54 which are attached to the tether 28 and to the socket housing 56. The springs 54 are circumferentially spaced about the tether 28, for example at 120° intervals.

It will be appreciated that although a rotating arm 22 is shown as the ball-delivering means, the basic invention of delivering a resiliently mounted ball having a preselected speed and trajectory between points P1 and P2 may be accomplished by using articulated arms, for example, rather than the purely rotating arm, 22. Although more complicated, articulated arms would be space saving.

The ball 30 may be fixedly attached to the tether 28 by any of several means well known in the art such as tapping and threading, glueing, molding, etc. The ball 30 may be a regulation baseball or softball or it may be simulated such as hard rubber, resilient plastic, etc.

What I claim is:

1. A pitching machine for batting practice comprising:

a base member;

a post member rotatably affixed to said base member and essentially perpendicular thereto;

an arm member affixed to said post member at essentially a right angle thereto and rotatable therewith and wherein said arm member is terminated at its free end by a semi-rigid tether;

a ball fixedly attached to the free end of said semi-rigid tether;

means for rotating said post member; and means for damping the oscillations of said ball.

2. The apparatus of claim 1 further including means for increasing and decreasing the length of said arm member thereby varying the distance from said ball to said post member.

3. The apparatus of claim 1 further including means for raising and lowering said arm member thereby varying the height of said ball above said base member.

* * * * *